US007727941B2

(12) United States Patent
Morrison et al.

(10) Patent No.: US 7,727,941 B2
(45) Date of Patent: Jun. 1, 2010

(54) SILICONE CONVEYOR LUBRICANT WITH STOICHIOMETRIC AMOUNT OF AN ACID

(75) Inventors: Eric D. Morrison, West St. Paul, MN (US); Richard D. Johnson, St. Paul, MN (US); Robert D. Hei, Baldwin, WI (US)

(73) Assignee: Ecolab Inc., St. Paul, MN (US)

( * ) Notice: Subject to any disclaimer, the term of this patent is extended or adjusted under 35 U.S.C. 154(b) by 1170 days.

(21) Appl. No.: 11/233,568

(22) Filed: Sep. 22, 2005

(65) Prior Publication Data

US 2007/0066496 A1 Mar. 22, 2007

(51) Int. Cl.
*C10M 169/04* (2006.01)
*C10M 173/00* (2006.01)
*C10M 155/02* (2006.01)

(52) U.S. Cl. ..... 508/144; 508/143

(58) Field of Classification Search ..... 508/136, 508/143, 144, 403, 405, 390
See application file for complete search history.

(56) References Cited

U.S. PATENT DOCUMENTS

| | | | |
|---|---|---|---|
| 3,011,975 | A | 12/1961 | Nitzsche |
| 3,213,024 | A | 10/1965 | Blake |
| 3,514,314 | A | 5/1970 | Nemeth |
| 3,664,956 | A | 5/1972 | Messina |
| 3,853,607 | A | 12/1974 | Iyengar |
| 3,981,812 | A | 9/1976 | Zietz |
| 4,062,785 | A | 12/1977 | Nibert |
| 4,065,590 | A | 12/1977 | Salensky |
| 4,069,933 | A | 1/1978 | Newing |
| 4,083,791 | A | 4/1978 | Elliott |
| 4,105,716 | A | 8/1978 | Sakai |
| 4,132,657 | A | 1/1979 | Verdicchio |
| 4,149,624 | A | 4/1979 | Douty |
| 4,162,347 | A | 7/1979 | Montgomery |
| 4,165,291 | A | 8/1979 | Gragson |
| 4,225,450 | A | 9/1980 | Rosenberger |
| 4,248,724 | A | 2/1981 | MacIntosh |
| 4,252,528 | A | 2/1981 | Decker |
| 4,262,776 | A | 4/1981 | Wilson |
| 4,264,650 | A | 4/1981 | Schulze |
| 4,274,973 | A | 6/1981 | Stanton |
| 4,289,671 | A | 9/1981 | Hernandez |
| 4,324,671 | A | 4/1982 | Christian |
| 4,343,616 | A | 8/1982 | Decker |
| 4,375,444 | A | 3/1983 | Deeken |
| 4,420,578 | A | 12/1983 | Hagens |
| 4,436,200 | A | 3/1984 | Hodlewski |
| 4,478,889 | A | 10/1984 | Maruhashi |
| 4,486,378 | A | 12/1984 | Hirata et al. |
| 4,515,836 | A | 5/1985 | Cobbs, Jr. |
| 4,525,377 | A | 6/1985 | Nickel |
| 4,534,995 | A | 8/1985 | Pocock |
| 4,538,542 | A | 9/1985 | Kennon |
| 4,543,909 | A | 10/1985 | Sharpless |
| 4,555,543 | A | 11/1985 | Effenberger |
| 4,569,869 | A | 2/1986 | Kushida |
| 4,573,429 | A | 3/1986 | Cobbs, Jr. |
| 4,604,220 | A | 8/1986 | Stanton |
| 4,632,053 | A | 12/1986 | Villanueva |
| 4,690,299 | A | 9/1987 | Cannon |
| 4,699,809 | A | 10/1987 | Maruhashi |
| 4,713,266 | A | 12/1987 | Hasegawa |
| 4,714,580 | A | 12/1987 | Maruhashi |
| 4,719,022 | A | 1/1988 | Hyde |
| 4,769,162 | A | 9/1988 | Remus |
| 4,828,727 | A | 5/1989 | McAninch |
| 4,851,287 | A | 7/1989 | Hartsing, Jr. |
| 4,855,162 | A | 8/1989 | Wrasidlo |
| 4,867,890 | A | 9/1989 | Colclough |
| 4,874,647 | A | 10/1989 | Yatsu |
| 4,919,984 | A | 4/1990 | Maruhashi |
| 4,929,375 | A | 5/1990 | Rossio |
| 4,980,211 | A | 12/1990 | Kushida |
| 4,995,993 | A | 2/1991 | Papke |
| 5,001,935 | A | 3/1991 | Tekkanat |
| 5,009,801 | A | 4/1991 | Wider |

(Continued)

FOREIGN PATENT DOCUMENTS

| | | |
|---|---|---|
| CA | 1157456 | 11/1983 |

(Continued)

OTHER PUBLICATIONS

Dow Corning *Emulsion* [*Online*] *1998*, XP002463027, URL: http://www2.dowcorning.com/DataFiles/090007c880001bdc.pdf, Dec. 19, 2007, 2 pages.

(Continued)

*Primary Examiner*—Glenn A Caldarola
*Assistant Examiner*—Pamela Weiss
(74) *Attorney, Agent, or Firm*—Andrew D. Sorensen; Laura C. Dilorenzo

(57) ABSTRACT

The passage of a container along a conveyor is lubricated by applying to the container or conveyor a composition comprising a water-miscible silicone material wherein the composition comprises a stoichiometric amount of an organic acid. The compatibility of the lubricating composition with polyethylene terephthalate is increased because of the presence of a stoichiometric amount of acid.

21 Claims, No Drawings

U.S. PATENT DOCUMENTS

| | | | |
|---|---|---|---|
| 5,032,301 | A | 7/1991 | Pawloski |
| 5,073,280 | A | 12/1991 | Rossio |
| 5,104,559 | A | 4/1992 | Pawloski |
| 5,115,047 | A | 5/1992 | Hashimoto |
| 5,145,721 | A | 9/1992 | Kojima |
| 5,160,646 | A | 11/1992 | Scheld |
| 5,174,914 | A | 12/1992 | Gutzmann |
| 5,182,035 | A | 1/1993 | Schmidt |
| 5,202,037 | A | 4/1993 | Lavelle |
| 5,238,718 | A | 8/1993 | Yano |
| 5,244,589 | A | 9/1993 | Liu |
| 5,317,061 | A | 5/1994 | Chu |
| 5,334,322 | A | 8/1994 | Williams, Jr. |
| RE34,742 | E | 9/1994 | Maier |
| 5,352,376 | A | 10/1994 | Gutzmann |
| 5,371,112 | A | 12/1994 | Sayre |
| 5,391,308 | A | 2/1995 | Despo |
| 5,411,672 | A | 5/1995 | Kagaya |
| 5,509,965 | A | 4/1996 | Harry |
| 5,510,045 | A | 4/1996 | Remus |
| 5,559,087 | A | 9/1996 | Halsrud |
| 5,565,127 | A | 10/1996 | Laufenberg |
| 5,573,819 | A | 11/1996 | Nugent, Jr. |
| 5,652,034 | A | 7/1997 | Seiner |
| 5,658,619 | A | 8/1997 | Kirschner |
| 5,663,131 | A | 9/1997 | Winicov |
| 5,670,463 | A | 9/1997 | Maples |
| 5,672,401 | A | 9/1997 | Anglin |
| 5,681,628 | A | 10/1997 | Niederst |
| 5,698,269 | A | 12/1997 | Carlblom |
| 5,721,023 | A | 2/1998 | Ostapchenko |
| 5,723,418 | A | 3/1998 | Person Hei |
| 5,728,770 | A | 3/1998 | Yamamoto |
| 5,747,431 | A | 5/1998 | Taylour |
| 5,783,303 | A | 7/1998 | Tsuei |
| 5,789,459 | A | 8/1998 | Inagaki |
| 5,863,874 | A | 1/1999 | Person Hei |
| 5,871,590 | A | 2/1999 | Hei |
| 5,876,812 | A | 3/1999 | Frisk |
| 5,925,601 | A | 7/1999 | McSherry |
| 5,932,526 | A | 8/1999 | Person |
| 5,935,914 | A | 8/1999 | Theyssen |
| 5,952,601 | A | 9/1999 | Sanford |
| 6,060,444 | A | 5/2000 | Schulz |
| 6,087,308 | A | 7/2000 | Butler |
| 6,096,692 | A | 8/2000 | Hagihara |
| 6,207,622 | B1 | 3/2001 | Li |
| 6,214,777 | B1 | 4/2001 | Li |
| 6,288,012 | B1 | 9/2001 | Li |
| 6,372,698 | B1 | 4/2002 | Strothoff |
| 6,427,826 | B1 | 8/2002 | Li |
| 6,495,494 | B1 | 12/2002 | Li et al. |
| 6,509,302 | B2 | 1/2003 | Li |
| 6,541,430 | B1 | 4/2003 | Beatty |
| 6,569,816 | B2 | 5/2003 | Oohira |
| 6,576,298 | B2 | 6/2003 | Bennett |
| 6,653,263 | B1 | 11/2003 | Küpper |
| 6,673,753 | B2 | 1/2004 | Person Hei |
| 6,677,280 | B2 | 1/2004 | Küpper |
| 6,688,434 | B2 | 2/2004 | Johnson |
| 6,696,394 | B1 | 2/2004 | Ruhr |
| 6,743,758 | B2 | 6/2004 | Li |
| 6,780,823 | B2 | 8/2004 | Li |
| 6,806,240 | B1 | 10/2004 | Hei |
| 6,809,068 | B1 | 10/2004 | Küpper |
| 6,821,568 | B2 | 11/2004 | Bennett |
| 6,855,676 | B2 | 2/2005 | Li et al. |
| 2002/0025912 | A1 | 2/2002 | Person Hei et al. |
| 2003/0073589 | A1 | 4/2003 | Li |
| 2004/0029741 | A1 | 2/2004 | Corby |
| 2004/0058829 | A1 | 3/2004 | Hei |
| 2004/0097382 | A1 | 5/2004 | Li |
| 2004/0102337 | A1 | 5/2004 | Li |
| 2004/0235680 | A1 | 11/2004 | Lawrence |

FOREIGN PATENT DOCUMENTS

| | | |
|---|---|---|
| DE | 19942535 | 3/2001 |
| EP | 0359330 | 3/1990 |
| EP | 0844299 | 5/1998 |
| GB | 1564128 | 4/1980 |
| JP | 57003892 | 1/1982 |
| JP | 6136377 | 5/1994 |
| JP | 7247293 | 9/1995 |
| JP | 7268380 | 10/1995 |
| JP | 10053679 | 2/1998 |
| JP | 10059523 | 3/1998 |
| JP | 2004217866 | 8/2004 |
| NL | 9300742 | 12/1993 |
| WO | WO96/08601 | 3/1996 |
| WO | WO98/51746 | 11/1998 |
| WO | WO01/07544 | 2/2001 |
| WO | WO01/12759 | 2/2002 |
| WO | WO02/20381 | 3/2002 |
| WO | WO03078557 | 9/2003 |
| WO | WO2006/009421 | 1/2006 |
| WO | WO2006/017503 | 2/2006 |
| WO | WO2007/040677 | 4/2007 |
| WO | WO2007/040678 | 4/2007 |

OTHER PUBLICATIONS

Gilbert, Peter, "*Conveyor Lubrication in Dairies, Breweries and Beverage Plants*", Klensan (Pty) Ltd., S.A. Food Review—Dec. 1981/Jan. 1982, pp. 27-28, 2 pages.

Gorton, Hugh J. Ph.D. and Taylour, Jim M. PhD. C Chem, "*The Development of New Conveyor Lubricant Technology*", MBAA Technical Quarterly, vol. 30, pp. 18-22, 1993, 5 pages.

U.S. Appl. No. 11/233,596, filed Sep. 22, 2005, Morrison.

U.S. Appl. No. 60/149,095, filed Aug. 16, 1999, Hei.

U.S. Appl. No. 60/149,048, filed Aug. 16, 1999, Hei.

U.S. Appl. No. 09/619,261, filed Jul. 19, 2000, Corby.

U.S. Appl. No. 60/230,662, filed Sep. 7, 2000, Bennett.

International Search Report of EP03076178 dated Jun. 12, 2003, 2 pgs.

European Search Report of EP03076177 dated Jul. 17, 2003, 2 pgs.

Dupont, "Krytox® Dry Film Lubricants", Nov. 1997, 6 pgs.

Ecolab, "Lube Application to Conveyor Surface/Containers", Jun. 13, 2000, 7 pgs.

Interflon, "Fin Food Lube Al. High Penetration Teflon® Lubricating Agent Especially Suitable for Automatic Lubrication Systems for the Food Processing Industry", 1998, 20 pgs.

Interflon, "Maintenance Products with Teflon®", http://www.interflon.nl/engels.htm, Jun. 18, 1999, 10 pgs.

Moskala, E., "Environmental Stress Cracking in PET Beverage Containers", Bev-Pak Americas '96, Apr. 15-16, 1996, 14 pgs.

Moskala, E., "Environmental Stress Cracking in PET Carbonated Soft Drink Containers", Bev Tech 98, Mar. 30-Apr. 1, 1998, 22 pgs.

Synco Chemical Corporation, "Other Super Lube Products . . . What is Super Lube®?" http://www.super-lube.com, May 5, 1999, 5 pgs.

Tekkanat, B. et al., "Environmental Stress Cracking Resistance of Blow Molded Poly(Ethylene Terephthalate) Containers", Polymer Engineering and Science, vol. 32, No. 6, Mar. 1992, pp. 393-397, 5 pgs.

US 5,863,871, 01/1999, Besse (withdrawn)

SILICONE CONVEYOR LUBRICANT WITH STOICHIOMETRIC AMOUNT OF AN ACID

FIELD OF THE INVENTION

This invention relates to conveyor lubricants and to a method for conveying articles. The invention also relates to conveyor systems and containers wholly or partially coated with such lubricant compositions.

BACKGROUND

In commercial container filling or packaging operations, the containers typically are moved by a conveying system at very high rates of speed. Dilute aqueous lubricant compositions are typically applied to the conveyor or containers using spray or pumping equipment. These lubricant compositions permit high-speed operation of the conveyor and limit marring of the containers or labels. One problem that can occur with thermoplastic beverage containers made from polyethylene terephthalate (PET) is environmental stress cracking. Stress cracking in polymers is the development of cracks normal to an applied stress as a result of stress promoted chemical degradation. Typically amorphous polymers are more susceptible to stress cracking. In the case of PET, it is the amorphous regions of a beverage container such as the center of the base of a PET bottle that are most susceptible to stress cracking. When stress cracks penetrate through the wall of a PET bottle, the bottle fails either by leaking or bursting. Because of environmental stress cracking, bottles filled with carbonated drinks are at risk for failure, especially at elevated temperatures (e.g., warmer weather, elevated storage temperatures, etc.). The risk of environmental stress cracking is exacerbated by the presence of materials which are incompatible with PET. Materials that, when in contact with PET increase the rate of occurrence of environmental stress cracking are considered incompatible with PET while materials that result in no increase in environmental stress cracking are considered compatible with PET. The failure rate of PET bottles is greater for bottles that have been contacted with alkaline water than for bottles that have been contacted with deionized water, thus it can be stated that the presence of alkalinity decreases the compatibility of aqueous compositions with PET bottles.

It is often the case that water used in the preparation of conveyor lubricant compositions contains alkalinity. For example, the alkalinity of water used for dilution of conveyor lubricants in bottling plants typically ranges between about 10 ppm and 100 ppm, expressed as ppm of $CaCO_3$ (calcium carbonate), with occasional values above 100 ppm. According to the International Society of Beverage Technologists web site, it is strongly recommended to keep the total alkalinity level (expressed as $CaCO_3$) below 50 mg/L (equivalent to 50 ppm as $CaCO_3$) in the water used to dilute lubricant concentrate compositions (lube make up water) in order to minimize the risk of stress crack failure. It is therefore important for conveyor lubricant compositions to show good compatibility with PET beverage bottles in the case that the dilution water contains alkalinity, particularly in the case that the dilution water exhibits alkalinity levels above 50 ppm and up to and in excess of 100 ppm, measured as $CaCO_3$.

Silicone based lubricants are preferred lubricants for PET bottles because they provide improved lubrication properties and significantly increased conveyor efficiency. Silicone containing lubricant compositions are described, for example in U.S. Pat. No. 6,495,494 (Li et. Al which is incorporated by reference herein in its entirety). However, aqueous silicone based lubricants may be considered to be less compatible with PET than other types of lubricants such as phosphate ester based lubricants. For example, conventional aqueous silicone lubricant compositions generally show a relatively higher incidence of stress cracking under conditions of high alkalinity. There has therefore been an unmet need in the field of conveyor lubrication which is an aqueous silicone conveyor lubricant that exhibits good compatibility with PET, particularly in the case that the lubricant contains alkalinity, for example from the dilution water.

It is against this background that the present invention has been made.

SUMMARY OF THE INVENTION

Surprisingly, it has been discovered that a silicone based lubricant with greater than a stoichiometric amount of an organic acid increases the compatibility of the silicone based lubricant with PET. By stoichiometric it is meant an amount of acid such that there is at least about one equivalent of available, unneutralized acid in the composition for each two equivalents of alkaline compounds present in water used for preparing the lubricant mixture. Water with 50 ppm alkalinity as calcium carbonate contains 0.001 equivalents of alkalinity per kg. In the case that the water alkalinity is equivalent to about 50 ppm $CaCO_3$, a stoichiometric amount of acid is therefore an amount of acid such that there will be greater than about 0.0005 equivalents of available, unneutralized acid per kilogram of the lubricant composition before reaction with alkalinity present in the water used to prepare the composition. Accordingly, the present invention provides, in one aspect, a method for lubricating the passage of a container along a conveyor comprising applying a composition of a water-miscible silicone material comprising one or more acid compounds in an amount sufficient to provide at least one equivalent of available, unneutralized acid for every two equivalents of alkalinity in water used to prepare the lubricant composition to at least a portion of the container contacting surface of the conveyor or to at least a portion of the conveyor-contacting surface of the container. The present invention provides, in another aspect, a method for lubricating the passage of a container along a conveyor comprising applying a composition of a water-miscible silicone material wherein the lubricant composition comprises greater than about 0.0005 equivalents of available, unneutralized acid per kilogram of the lubricant composition before reaction with alkalinity present in the water used to prepare the composition. The present invention provides, in another aspect, a method for lubricating the passage of a container along a conveyor comprising applying a composition of a water-miscible silicone material comprising one or more acid compounds in an amount sufficient to provide a pH of less than about 6.4 when the lubricant concentrate is diluted with water comprising greater than about 50 ppm alkalinity as $CaCO_3$ to at least a portion of the container contacting surface of the conveyor or to at least a portion of the conveyor-contacting surface of the container. The invention provides, in another aspect, conveyor lubricant compositions comprising a water-miscible silicone material and greater than about 0.0005 equivalents of available, unneutralized acid per kilogram of the lubricant composition before reaction with alkalinity present in the water used to prepare the composition. The present invention provides, in another aspect, a lubricant concentrate composition comprising a water-miscible silicone material and greater than about 0.05 equivalents of unneutralized acid per kg of the lubricant concentrate composition. These and other aspects of this invention will be evident upon reference to the following detailed description of the invention.

DETAILED DESCRIPTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Compositions

The invention provides a lubricant coating that reduces the coefficient of friction of coated conveyor parts and containers and thereby facilitates movement of containers along a conveyor line. The present invention provides in one aspect, a method for lubricating the passage of a container along a conveyor comprising applying a composition of a water-miscible silicone material to at least a portion of the container contacting surface of the conveyor or to at least a portion of the conveyor-contacting surface of the container, wherein the lubricant composition comprises one or more acid compounds in an amount sufficient to provide at least one equivalent of available, unneutralized acid for every two equivalents of alkalinity in water used to prepare the lubricant composition. The available unneutralized acid comes from one or more acid compounds present in the lubricant composition. The concentration of available, unneutralized acid before reaction with alkalinity present in the water used to prepare the composition can be determined by preparing a composition with deionized water and titrating the acid to approximately pH 8.3, or by calculating the concentration of acid present in a composition diluted with deionized water using formulation data. For example, if the lubricant concentrate of Example 1 was diluted with deionized water instead of water containing 168 ppm sodium bicarbonate, there would be 0.0034 equivalents of succinic acid per kg of the use composition and 0.0009 equivalents of sodium hydroxide per kg of the use composition, and therefore 0.0025 equivalents of available, unneutralized succinic acid per kg of the use composition before reaction with alkalinity present in the water. The total alkalinity of the water used to dilute the lubricant concentrate composition can be determined by an acid base titration. For example, 1000 g of the water used to dilute the lubricant concentrate composition can be titrated to approximately pH 4.3 using 0.1 N HCl solution. In this case, the ppm alkalinity as $CaCO_3$ per mL of titrant can be calculated according to:

$$\text{alkalinity as } CaCO_3 \text{ per 1.0 mL of titrant} = \frac{(1.0\text{ mL}) \times (0.1\text{ equivalent}/1000\text{ mL}) \times (50\text{ g } CaCO_3/\text{equivalent})}{1000\text{ g}} = 0.005\text{ g } CaCO_3/1000\text{ g} = 50\text{ ppm as } CACO_3 \text{ per mL of titrant.}$$

The total alkalinity of the water used to dilute the lubricant concentrate composition in the Examples herein can be calculated by formulation. For example, in Example 1 the ppm alkalinity as $CaCO_3$ of water containing 168 ppm $NaHCO_3$ can be calculated according to:

$$\text{alkalinity as } CaCO_3 = \frac{(0.168\text{ g } NaHCO_3/1000\text{ g})}{84\text{ g } NaHCO_3/\text{equivalent}} \times (50\text{ g } CaCO_3/\text{equivalent}) = 0.100\text{ g } CaCO_3/1000\text{ g} = 100\text{ ppm alkalinity as } CaCO_3$$

Lubricant compositions according to the present invention will contain in addition to the water-miscible silicone material unneutralized acid compounds. Lubricant compositions of the present invention may also optionally include, in addition to silicone and unneutralized acid compounds, water-miscible lubricants, wetting agents that improve the wetting of the lubricant to PET, and other functional ingredients.

Ester bonds as are present in PET are well known to hydrolyze under conditions of either acid or base catalysis. It is expected that the overall rate of ester bond hydrolysis would be at a minimum at approximately neutral pH, where both hydronium ions and hydroxide ions are present at minimum concentrations. Surprisingly it has been found that the "compatibility" of a silicone emulsion based conveyor lubricant composition prepared with water containing bicarbonate alkalinity is not improved when the lubricant composition has approximately neutral pH, but instead is improved when the lubricant composition has at least a stoichiometric amount of unneutralized acid, in which case the pH is less than about 6.4. For example, addition of sufficient acid to adjust the pH of a conveyor lubricant use composition down to 7.20 did not result in a decrease in the failure rate of carbonated PET bottles contacted with the lubricant composition relative to a control composition with pH equal to 8.20. By stoichiometric it is meant an amount of acid such that there is at least about one equivalent of available, unneutralized acid in the composition for every two equivalents of alkaline compounds present in water used for preparing the lubricant composition. In the case that the water used for preparing the lubricant composition comprises alkalinity equivalent to 50 ppm as $CaCO_3$, a stoichiometric amount of acid is an amount of acid such that there will be about 0.0005 equivalents or more of available, unneutralized acid in the lubricant composition before reaction with alkaline compounds present in the water used to prepare the composition. The compatibility of lubricant use compositions is improved even more in the case that there are two times or four times a stoichiometric amount of acid.

While we do not wish to be bound by theory, it is believed that neutralizing alkalinity to neutral pH does not improve the compatibility because the pH can subsequently increase upon complete or partial evaporation of the lubricant composition and consequent loss of carbon dioxide. It is believed that sufficient acid is required in order to substantially oppose upward shifts in system pH that can occur by evaporative loss of carbon dioxide. As used herein, "system" refers to the liquid lubricant composition as it contacts the PET bottle, the residue that is left on the bottle after evaporation and all forms intermediate between starting liquid and final residue. According to the well known Henderson-Hasselbach equation, the pH of an acid solution is equal to the pKa value of the acid when it is half neutralized, that is when there are equimolar concentrations of the acid and the conjugate base in solution. Bicarbonate anion is the conjugate base of carbonic acid, $H_2CO_3$. The pKa value for the first ionization of carbonic acid is often quoted as approximately 6.4 (Weast, R. C., Editor (1976) *CRC Handbook, 57th Edition,* Cleveland Ohio: Chemical Rubber Publishing Company). This value is in fact misleading because it incorporates the equilibrium constant between dissolved carbon dioxide and carbonic acid, and the pKa value of 6.4 is better described as the acidity constant of carbon dioxide, not carbonic acid (Cotton, F. A. and Wilkinson, G (1980) *Advanced Inorganic Chemistry, Fourth Edition*, New York, N.Y.: John Wiley and Sons). Thus at about pH 6.4, bicarbonate anion exists in a complex equilibrium with carbonic acid and dissolved carbon dioxide. When there is provided a stoichiometric amount of available unneutralized acid, that is, at least about one equivalent of available, unneutralized acid in the composition for every two equivalents of bicarbonate anion present in the water used for preparing the lubricant before reaction, at equilibrium the concentration of acid species (primarily dissolved carbon dioxide) will be greater than approximately the concentration of bicarbonate anion and the pH of the buffered system will be less than or equal to approximately 6.4. More preferably, when there are provided two times a stoichiometric amount of available unneutralized acid, that is, two equivalents of available, unneutralized acid in the composition for every two equivalents of bicarbonate anion present in the water used for preparing the lubricant before reaction there will be a much lower concentration of bicarbonate ion at equilibrium. In this case if even if complete loss of $CO_2$ from the system occurs, there will remain only the conjugate base of the provided acid and further loss of $CO_2$ from unneutralized bicarbonate anion to give more basic and potentially more PET incompatible anions such as carbonate and hydroxide ions is prevented. Even more preferably, there is provided three times a stoichiometric amount of available unneutralized acid, that is, three equivalents of available, unneutralized acid in the composition for every two equivalents of alkalinity present in the water used for preparing the lubricant before reaction. In this case, if complete loss of $CO_2$ from the system occurs, there will be a mixture of the added acid and its conjugate base. Surprisingly, the presence of three or more equivalents of available, unneutralized acid in the composition has been found to give greatly improved PET compatibility, in spite of the presence of excess acid in the case that carbon dioxide is not lost from the system or in the case the composition is prepared with water that is free from alkalinity.

Regardless of the mechanism, the present invention has been observed to reduce stress cracking in PET bottles when compared to prior art and comparison compositions, based on the presence of a stoichiometric amount of an organic acid. Accordingly, compositions of the present invention comprise at least a stoichiometric amount of acid and comprise, for every two equivalents of alkalinity in water used to prepare the composition, at least about one equivalent, at least about two equivalents, or at least about three equivalents of acid, before reaction with alkalinity in the water used to prepare the composition.

In the case that the water alkalinity is equivalent to about 50 ppm $CaCO_3$, a stoichiometric amount of acid is an amount of acid such that there will be about 0.0005 equivalents or more of available, unneutralized acid per kilogram of the mixture in the lubricant mixture before reaction with alkalinity. Accordingly, compositions of the present invention comprise available, unneutralized acid in an amount at least about 0.0005 equivalents per kilogram, at least about 0.001 equivalents per kilogram, or at least about 0.002 equivalents per kilogram of composition.

In compositions that comprise a stoichiometric amount of acid, that is, at least about one equivalent of available, unneutralized acid for every two equivalents of alkalinity, the concentration of the conjugate acid of bicarbonate anion will be present in a concentration greater than approximately the concentration of bicarbonate anion, in which case the composition pH will be less than approximately the carbon dioxide/bicarbonate pKa value which is approximately 6.4. Accordingly, when prepared with water containing greater than about 50 ppm alkalinity as $CaCO_3$, compositions of the present invention have pH less than about 6.4, less than about 6.0, or less than about 5.

Lubricant compositions of the present invention can be applied undiluted or may be diluted before use. It may be desirable to provide compositions of the present invention in the form of concentrates that can be diluted with water at the point of use to give use compositions. Inventive lubricant concentrate compositions comprise a water-miscible silicone material and an amount of available, unneutralized acid effective to provide at least about 0.0005 equivalents of available, unneutralized acid per Kg in a lubricant composition that results from diluting one part of the lubricant concentrate with between 100 and 1000 parts of water and/or hydrophilic diluent. Accordingly, lubricant concentrate compositions comprise at least about 0.05 equivalents per liter, at least about 0.1 equivalents per liter, or at least about 0.2 equivalents per liter of available, unneutralized acid.

The silicone material and acid are "water-miscible", that is, they are sufficiently water-soluble or water-dispersible so that when added to water at the desired use level they form a stable solution, emulsion, or suspension. The desired use level will vary according to the particular conveyor or container application, and according to the type of silicone and wetting agent employed.

The present invention includes one or more water-miscible silicone materials. A variety of water-miscible silicone materials can be employed in the lubricant compositions, including silicone emulsions (such as emulsions formed from methyl(dimethyl), higher alkyl and aryl silicones; and functionalized silicones such as chlorosilanes; amino-, methoxy-, epoxy- and vinyl-substituted siloxanes; and silanols). Suitable silicone emulsions include E2175 high viscosity polydimethylsiloxane (a 60% siloxane emulsion commercially available from Lambent Technologies, Inc.), E2140 polydimethylsiloxane (a 35% siloxane emulsion commercially available from Lambent Technologies, Inc.), E21456 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30-60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones). Other water-miscible silicone materials include finely divided silicone powders such as the TOSPEARL™ series (commercially available from Toshiba Silicone Co. Ltd.); and silicone surfactants such as SWP30 anionic silicone surfactant, WAXWS-P nonionic silicone surfactant, QUATQ-400M cationic silicone surfactant and 703 specialty silicone surfactant (all commercially available from Lambent Technologies, Inc.).

Polydimethylsiloxane emulsions are preferred silicone materials. Generally the concentration of the active silicone material useful in the present invention exclusive of any dispersing agents, water, diluents, or other ingredients used to emulsify the silicone material or otherwise make it miscible with water falls in the range of about 0.0005 wt. % to about 5.0 wt. %, preferably 0.001 wt. % to about 1.0 wt. %, and more preferably 0.002 wt. % to about 0.50 wt. %. In the case that the lubricant composition is provided in the form of a concentrate, the concentration of active silicone material useful in the present invention exclusive of any dispersing agents, water, diluents, or other ingredients used to emulsify the silicone material or otherwise make it miscible with water falls in the range of about 0.05 wt. % to about 20 wt. %, preferably 0.10 wt. % to about 5 wt. %, and more preferably 0.2 wt. % to about 1.0 wt. %.

The present invention includes one or more acid compounds. Preferred acids for this invention have pKa values between about 2.0 and about 6.4, that is, they are relatively weaker acids. It is believed that the pKa value must be below about 6.4, that is, sufficiently strong that bicarbonate anion will be substantially protonated. The pKa value is not required to be lower than that of carbonic acid which is approximately 3.6, again owing to the complex equilibrium between dissolved carbon dioxide, carbonic acid, and bicarbonate anion. Acids with pKa values above about 2.0 are preferred because acids with lower pKa values, i.e. stronger acids, will result in objectionably low pH for lubricant concentrate compositions and for lubricant use compositions that have been prepared with water free from alkalinity. The pKa value is important because it determines the pH of the concentrated lube composition and the diluted use lubricant composition. Using acids that are too strong (that is, have low pKa values below about 2.0) will result in undesirably low pH in the concentrated lubricant composition and in lubricant compositions that have been diluted with water that does not contain alkalinity. Relatively higher pH of the lubricant concentrate is valuable because it reduces the corrosivity of the composition and makes the composition less hazardous to manufacture, package, transport and store. Relatively higher pH of the use composition makes the composition less corrosive and more compatible with dispensing equipment and conveyor equipment. Examples of inorganic acids with pKa values between 2.5 and about 6.4 include dialkyl phosphoric acid compounds, disodium dihydrogen pyrophosphate ($Na_2H_2P_2O_7$), and nitrous acid. Useful organic acids include carboxylic acids and anilinium salts. Preferred organic acids are carboxylic acid compounds. Particularly preferred acids are di- or poly-functional organic compounds. By di- or poly-functional it is meant that the organic compound contains, in addition to one carboxylic acid group, one or more of a second functional moiety selected from the group including carboxylic acid, ketone, aldehyde, ester, carbonate, urea, amide, ether, amine, ammonium, and hydroxyl groups. The importance of a second functional group on the carboxylic acid compound molecule is it minimizes the volatility and odor of the acid. Particularly preferred acids are sufficiently non-volatile so as to not provide an objectionable odor. Useful carboxylic acid compounds in the present invention include formic, acetic, propionic, hydroxy acetic, lactic, malonic, maleic, succinic, glutaric, adipic, hydroxy succinic, malic, fumaric, itaconic, citric, and gluconic acids, and carboxylic acid functional polymers such as homopolymers and copolymers of acrylic acid, methacrylic acid, maleic acid, and itaconic acid, and mixtures thereof. In compositions of the present invention, carboxylic acid compounds can also act as corrosion inhibitors. A preferred acid is a mixture of adipic, glutaric and succinic acid commercially available from BASF under the trade name SOKALAN™ DCS.

In preferred compositions of the present invention, particularly concentrate compositions, it might be desirable to partially neutralize acids. By partially neutralizing acids in lubricant compositions of the present invention, the pH of the lubricant concentrate and the pH of the lubricant use composition that has been prepared using water with low alkalinity can be increased. Relatively higher pH of the lubricant concentrate is valuable because it reduces the corrosivity of the composition and makes the composition less hazardous to manufacture, package, transport and store. Relatively higher pH of the use composition makes the composition less corrosive and more compatible with dispensing equipment and conveyor equipment. In the case that acid compounds are partially neutralized, it is important that there remains at least about one equivalent of available, unneutralized acid in the mixture for each equivalent of alkaline compounds in the mixture, where the alkaline compounds originate from water used to prepare the mixture.

In preferred compositions of the present invention, organic acids may be present as peracids. Typically peracid compounds are in equilibrium with hydrogen peroxide and organic acids. By providing organic acids in the form of peracids, the pH of the lubricant concentrate can be increased.

Care should be taken to avoid the use of acids that might promote environmental stress cracking in plastic containers when evaluated using the PET stress Crack Test Set out below. Examples of preferred acids include acetic, lactic, succinic, glutaric, adipic, and citric acid and partially neutralized compositions thereof. Examples of particularly preferred lubricant compositions include those having from about 0.001 to about 0.02% of a water-miscible silicone material and from about 0.01 to about 0.10% of a mixture of citric acid and dihydrogen citrate anion.

Examples of particularly preferred lubricant concentrate compositions include those having from about 0.10% to about 2% of a water-miscible silicone material and about 4% to about 20% of a mixture of citric acid and dihydrogen citrate anion.

Particularly preferred lubricant compositions are substantially aqueous that is, they comprise greater than about 99% of water.

Lubricant compositions of the present invention can be applied as is or may be diluted before use. It may be desirable to provide compositions of the present invention in the form of concentrates that can be diluted with water at the point of use to give use compositions. If diluted, preferred ratios for dilution at the point of use range from about 1:100 to 1:1000 (parts of concentrate: parts of water).

In the case that lubricant compositions are provided in the form of concentrates, it is particularly preferred to select silicone materials and acids that form stable compositions at 100 to 1000 times the concentration of the use composition.

Preferred lubricant compositions may also contain a wetting agent. Lubricant compositions that comprise a wetting agent and have improved compatibility with PET are disclosed in assignee's copending patent application, titled SILICONE LUBRICANT WITH GOOD WETTING ON PET SURFACES, filed on Sep. 22, 2005, which application is incorporated herein by reference in its entirety. Compositions which comprise both a stoichiometric amount of acid and wetting agent sufficient to lower the contact angle to less than about 60 degrees may exhibit a synergistic effect, that is, the overall reduction of the failure rate for PET bottles may be greater than the sum of the reduction of the failure rate for either a stoichiometric amount of acid or wetting agent alone.

The lubricant compositions can contain functional ingredients if desired. For example, the compositions can contain hydrophilic diluents, antimicrobial agents, stabilizing/coupling agents, detergents and dispersing agents, anti-wear agents, viscosity modifiers, sequestrants, corrosion inhibitors, film forming materials, antioxidants or antistatic agents. The amounts and types of such additional components will be apparent to those skilled in the art.

Water-Miscible Lubricants

A variety of water-miscible lubricants can be employed in the lubricant compositions, including hydroxy-containing compounds such as polyols (e.g., glycerol and propylene glycol); polyalkylene glycols (e.g., the CARBOWAX™ series of polyethylene and methoxypolyethylene glycols, commercially available from Union Carbide Corp.); linear copolymers of ethylene and propylene oxides (e.g., UCON™ 50-HB-100 water-soluble ethylene oxide:propylene oxide copolymer, commercially available from Union Carbide Corp.); and sorbitan esters (e.g., TWEEN™ series 20, 40, 60, 80 and 85 polyoxyethylene sorbitan monooleates and SPAN™ series 20, 80, 83 and 85 sorbitan esters, commercially available from ICI Surfactants). Other suitable water-miscible lubricants include phosphate esters, amines and their derivatives, and other commercially available water-miscible lubricants that will be familiar to those skilled in the art. Derivatives (e.g., partial esters or ethoxylates) of the above lubricants can also be employed. For applications involving plastic containers, care should be taken to avoid the use of water-miscible lubricants that might promote environmental stress cracking in plastic containers when evaluated using the PET Stress Crack Test set out below. Preferably the water-miscible lubricant is a polyol such as glycerol or a linear copolymer of ethylene and propylene oxides.

Hydrophilic Diluents

Suitable hydrophilic diluents include alcohols such as isopropyl alcohol, polyols such as ethylene glycol and glycerine, ketones such as methyl ethyl ketone, and cyclic ethers such as tetrahydrofuran. For applications involving plastic containers, care should be taken to avoid the use of hydrophilic diluents that might promote environmental stress cracking in plastic containers when evaluated using the PET Stress Crack Test set out below.

Antimicrobial Agents

Anti-microbial agents can also be added. Some useful antimicrobial agents include disinfectants, antiseptics, and preservatives. Some non-limiting examples include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, peroctanoic acid, methyl p-hydroxy benzoic acid, cationic agents such as quaternary ammonium compound, phosphonium compounds such as tetrakishydroxymethyl phosphonium sulphate (THPS), aldehydes such as glutaraldehyde, antimicrobial dyes such as acridines, triphenylmethane dyes and quinines, halogens including iodine and chlorine compounds and oxidizers such as ozone, and hydrogen peroxide. The antimicrobial agents can be used in amounts to provide the desired antimicrobial properties. In some examples, the amount can range from 0 to about 20 wt.-% of the total composition.

Stabilizing/Coupling Agents

In a lubricant concentrate, stabilizing agents, or coupling agents can be employed to keep the concentrate homogeneous, for example, under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as hexylene glycol, propylene glycol and the like. The stabilizing/coupling agents can be used in an amount to give desired results. This amount can range, for example, from about 0 to about 30 wt.-% of the total composition.

Detergents/Dispersing Agents

Detergents of dispersing agents may also be added. Some examples of detergents and dispersants include alkylbenzenesulfonic acid, alkylphenols, carboxylic acids, alkylphosphonic acids, and their calcium, sodium, and magnesium salts, polybutenylsuccinic acid derivatives, silicone surfactants, fluorosurfactants, and molecules containing polar groups attached to an oil-solubilizing aliphatic hydrocarbon chain.

Some examples of suitable dispersing agents include triethanolamine, alkoxylated fatty alkyl monoamines and diamines such as coco bis (2-hydroxyethyl)amine, polyoxyethylene(5-)coco amine, polyoxyethylene(15)coco amine, tallow bis(-2hydroxyethyl)amine, polyoxyethylene(15) amine, polyoxyethylene(5)oleyl amine and the like.

The detergent and/or dispersants can be used in an amount to give desired results. This amount can range, for example, from about 0 to about 30 wt.-% of the total composition.

Anti-Wear Agents

Anti-wear agents can also be added. Some examples of anti-wear agents include zinc dialkyl dithiophosphates, tricresyl phosphate, and alkyl and aryl disulfides and polysulfides. The anti-wear and/or extreme pressure agents are used in amounts to give the desired results. This amount can range, for example, from 0 to about 20 wt.-% of the total composition.

Viscosity Modifiers

Viscosity modifiers can also be used. Some examples of viscosity modifiers include pour-point depressants and viscosity improvers, such as polymethacrylates, polyisobutylenes polyacrylamides, polyvinyl alcohols, polyacrylic acids, high molecular weight polyoxyethylenes, and polyalkyl styrenes. The modifiers can be used in amounts to provide the desired results. In some embodiments, the viscosity modifiers can range from 0 to about 30 wt.-% of the total composition.

Sequestrants

In addition to the aforementioned ingredients, it is possible to include other chemicals in the lubricant concentrates. For example, where soft water is unavailable and hard water is used for the dilution of the lubricant concentrate, there is a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion.

Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA), such as Versene products which are $Na_2EDTA$ and $Na_4EDTA$ sold by Dow Chemicals. Some additional examples of other sequestrants include: iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, sodium salt of sodium glucoheptonate, and the like.

Corrosion Inhibitors

Useful corrosion inhibitors include polycarboxylic acids such as short chain carboxylic diacids, triacids, as well as phosphate esters and combinations thereof. Useful phosphate esters include alkyl phosphate esters, monoalkyl aryl phosphate esters, dialkyl aryl phosphate esters, trialkyl aryl phosphate esters, and mixtures thereof such as Emphos PS 236 commercially available from Witco Chemical Company. Other useful corrosion inhibitors include the triazoles, such as benzotriazole, tolyltriazole and mercaptobenzothiazole, and in combinations with phosphonates such as 1-hydroxyethylidene-1,1-diphosphonic acid, and surfactants such as oleic acid diethanolamide and sodium cocoamphohydroxy propyl sulfonate, and the like. Useful corrosion inhibitors include polycarboxylic acids such as dicarboxylic acids. The acids which are preferred include adipic, glutaric, succinic, and mixtures thereof. The most preferred is a mixture of adipic, glutaric and succinic acid, which is a raw material sold by BASF under the name SOKALAN™ DCS.

Preferred lubricant compositions may be foaming, that is, they may have a foam profile value greater than about 1.1 when measured using a Foam Profile Test. Conveyor lubricants that contain silicone and foam are heretofore unknown. Lubricant compositions which exhibit foam profile values greater than about 1.1 may be advantageous because they offer a visual indication of the presence of lubricant, because foam allows movement of lubricant to areas of the conveyor that are not wetted directly by nozzles, brushes, or other means of application, and because foam enhances contact of the lubricant composition with the package being conveyed. Lubricant compositions preferably have a foam profile value that is greater than about 1.1, more preferably greater than about 1.3, and most preferably greater than about 1.5, when evaluated using the Foam Profile Test described below.

The lubricant compositions preferably create a coefficient of friction (COF) that is less than about 0.20, more preferably less than about 0.15, and most preferably less than about 0.12, when evaluated using the Short Track Conveyor Test described below.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant composition can also be applied to a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The containers can have a variety of sizes and forms, including cartons (e.g., waxed cartons or TETRA-PACK™ boxes), cans, bottles and the like. Although any desired portion of the container can be coated with the lubricant composition, the lubricant composition preferably is applied only to parts of the container that will come into contact with the conveyor or with other containers. For some such applications the lubricant composition preferably is applied to the conveyor rather than to the container.

The lubricant composition can be a liquid or semi-solid at the time of application. Preferably the lubricant composition is a liquid having a viscosity that will permit it to be pumped and readily applied to a conveyor or containers, and that will facilitate rapid film formation whether or not the conveyor is in motion. The lubricant composition can be formulated so that it exhibits shear thinning or other pseudo-plastic behavior, manifested by a higher viscosity (e.g., non-dripping behavior) when at rest, and a much lower viscosity when subjected to shear stresses such as those provided by pumping, spraying or brushing the lubricant composition. This behavior can be brought about by, for example, including appropriate types and amounts of thixotropic fillers (e.g., treated or untreated fumed silicas) or other rheology modifiers in the lubricant composition.

Methods of Application

The lubricant coating can be applied in a constant or intermittent fashion. Preferably, the lubricant coating is applied in an intermittent fashion in order to minimize the amount of applied lubricant composition. It has been discovered that the compositions of the present invention may be applied intermittently and maintain a low coefficient of friction in between applications, or avoid a condition known as "drying". Specifically, compositions of the present invention may be applied for a period of time and then not applied for at least 15 minutes, at least 30 minutes, or at least 120 minutes or longer. The application period may be long enough to spread the composition over the conveyor belt (i.e. one revolution of the conveyor belt). During the application period, the actual application may be continuous, i.e. lubricant is applied to the entire conveyor, or intermittent, i.e. lubricant is applied in bands and the containers spread the lubricant around. The lubricant is preferably applied to the conveyor surface at a location that is not populated by packages or containers. For example, it is preferable to apply the lubricant spray upstream of the package or container flow or on the inverted conveyor surface moving underneath and upstream of the container or package.

In some embodiments, the ratio of application time to non-application time may be 1:10, 1:30, 1:180, and 1:500 where the lubricant maintains a low coefficient of friction in between lubricant applications.

In some embodiments, the lubricant maintains a coefficient of friction below about 0.2, below about 0.15, and below about 0.12.

In some embodiments, a feedback loop may be used to determine when the coefficient of friction reaches an unacceptably high level. The feedback loop may trigger the lubricant composition to turn on for a period of time and then optionally turn the lubricant composition off when the coefficient of friction returns to an acceptable level.

The lubricant coating thickness preferably is maintained at least about 0.0001 mm, more preferably about 0.001 to about 2 mm, and most preferably about 0.005 to about 0.5 mm.

Application of the lubricant composition can be carried out using any suitable technique including spraying, wiping, brushing, drip coating, roll coating, and other methods for application of a thin film.

The lubricant compositions can if desired be evaluated using a Contact Angle Measurement Test, a Coating Test, a Short Track Conveyor Test, a Foam Profile Test, and a PET Stress Crack Test.

Contact Angle Measurement Test

For the present invention, the contact angle of lubricant use compositions was measured using an FTÅ 200 Dynamic Contact Angle Analyzer available from First Ten Angstroms, Portsmouth, Va. A droplet of use composition was applied to Melinex 516 uncoated polyethylene terephthalate film using a 1 inch 22 gauge needle and the contact angle measured 10 seconds after applying the drop to the film. Melinex 516 film is a product of Dupont Teijin Films and is available in sheets from GE Polymershapes, Huntersville, N.C.

Coating Test

A wet coating of lubricant composition was prepared by pipetting approximately 4 mL of lubricant composition onto an approximately 90 square inch sample of Melinex 516 uncoated polyethylene terephthalate film and spreading the puddle across the film surface by hand using a number 6 Mayer bar (available from RD Specialties, Webster N.Y.). The thickness of the wet coating was approximately 14 microns. The wet film was observed for wetting properties and defects in the wet coating including beading up and localized de-wetting. The coating was allowed to dry under ambient conditions and the properties of the dried film noted including contiguity and percent surface coverage.

Short Track Conveyor Test

A conveyor system employing a motor-driven 83 mm wide by 6.1 meter long REXNORD™ LF polyacetal thermoplastic conveyor belt was operated at a belt speed of 30.48 meters/minute. Four 20 ounce filled PET beverage bottles were lassoed and connected to a stationary strain gauge. The force exerted on the strain gauge during belt operation was recorded using a computer. A thin, even coat of the lubricant composition was applied to the surface of the belt using conventional lubricant spray nozzles which apply a total of 4 gallons of lubricant composition per hour. The belt was allowed to run for 25 to 90 minutes during which time a consistently low drag force was observed. The coefficient of friction (COF) was calculated by dividing the drag force (F) by the weight of the four 20 ounce filled PET beverage bottles (W): COF=F/W.

Foam Profile Test

According to this test, 200 mL of room temperature lubricant composition in a stoppered 500 mL glass graduated cylinder was inverted 10 times. Immediately after the tenth inversion, the total volume of liquid plus foam was recorded. The stoppered cylinder was allowed to remain stationary, and 60 seconds after the last inversion of the cylinder the total volume of liquid plus foam was recorded. The foam profile value is the ratio of the total volume of liquid plus foam at 60 seconds divided by the original volume.

PET Stress Crack Test

Compatibility of lubricant compositions with PET beverage bottles was determined by charging bottles with carbonated water, contacting with lubricant composition, storing at elevated temperatures and humidity for a period of 28 days, and counting the number of bottles that either burst or leaked through cracks in the base portion of the bottle. Standard twenty ounce "Global Swirl" bottles (available from Constar International) were charged successively with 658 g of chilled water at 0 to 5 C, 10.6 g of citric acid, and 10.6 g of sodium bicarbonate. Immediately after addition of sodium bicarbonate, the charged bottle was capped, rinsed with deionized water and stored at ambient conditions (20-25 C) overnight. Twenty four bottles thus charged were dipped in lubricant working composition up to the seam which separates the base and sidewall portions of the bottle and swirled for approximately five seconds, then placed in a standard bus pan (part number 4034039, available from Sysco, Houston Tex.) lined with a polyethylene bag. Additional lubricant working composition was poured into the bus pan around the bottles so that the total amount of lubricant composition in the pan (carried in on bottles and poured in separately) was equal to 132 g. The lubricant composition was not foamed for this test. For each lubricant tested, a total of four bus pans of 24 bottles were used. Immediately after placing bottles and lubricant into bus pans, the bus pans were removed to a humidity chamber under conditions of 100 F and 85% relative humidity. Bins were checked on a daily basis and number of failed bottles (burst or leak of liquid through cracks in the bottle base) was recorded. At the end of 28 days, the amount of crazing on the base region of bottles that did not fail during humidity testing was evaluated. A visual crazing score was given to bottles where 0=no crazing is evident, the bottle base remains clear; and 10=pronounced crazing to the extent that the base has become opaque.

EXAMPLES

The invention can be better understood by reviewing the following examples. The examples are for illustration purposes only, and do not limit the scope of the invention.

Comparative Example A

Deionized Water with 100 ppm Added Alkalinity

A solution of deionized water containing 100 ppm alkalinity as $CaCO_3$ was prepared by dissolving 0.168 g of sodium bicarbonate in 1000 g of deionized water. The ratio of unneutralized acid equivalents to equivalents of base from the alkaline water was 0 to 1.00. The wetting behavior of the solution was evaluated by the coating test described above. Upon coating, the solution beaded up immediately giving isolated drops which dried to give water spots which covered approximately 5% of the film surface. The alkaline water solution was tested for PET compatibility as described above. After 28 days of storage under conditions of 100 F and 85% relative humidity, 19 of 120 bottles had failed (16%). The visual crazing score for the unfailed bottles in this test was 1.4.

Comparative Example B

Silicone Plus Water-Miscible Lubricant

A lubricant composition was prepared which contained 125 ppm Lambent E2140FG silicone emulsion, 7.5 ppm Pluronic F108 poly(ethylene oxide-propylene oxide) block copolymer, 5.0 ppm methyl paraben, and 168 ppm sodium bicarbonate (equivalent to 100 ppm alkalinity as $CaCO_3$). The ratio of unneutralized acid equivalents to equivalents of base from the alkaline water was 0 to 1.00. The contact angle of the lubricant composition on PET film was determined to be 64 degrees and the pH of the lubricant composition was 8.7. The wetting behavior of the lubricant composition was evaluated by the coating test described above. Upon coating, the composition beaded up immediately giving isolated drops which dried to give water spots which covered approximately 5% of the film surface. The silicone plus water-miscible lubricant composition was tested for PET compatibility whereupon after 28 days of storage under conditions of 100 F and 85% relative humidity, 9 of 48 bottles had failed (19%). What this comparative example shows is that addition of a composition of silicone plus water-miscible lubricant to alkaline water does not cause a significant improvement in the proportion of failed bottles in the PET compatibility test relative to alkaline water alone.

Comparative Example C

Commercial Silicone Lubricant

A commercial lubricant composition was prepared which contained 2500 ppm of Dicolube TPB (product of Johnson Diversey) and 168 ppm sodium bicarbonate (equivalent to 100 ppm alkalinity as $CaCO_3$). The ratio of unneutralized acid equivalents from the lubricant concentrate composition to equivalents of base from the alkaline water was 0 to 1.00. The contact angle of the lubricant composition on PET film was determined to be 72 degrees. The wetting behavior of the lubricant composition was evaluated by the coating test described above. Upon coating, the composition beaded up immediately giving isolated drops which dried to give water spots which covered less than 5% of the film surface. The commercial lubricant composition was tested for PET compatibility whereupon after 28 days of storage under conditions of 100 F and 85% relative humidity, 7 of 48 bottles had failed (15%). What this comparative example shows is that addition of a composition of a commercial silicone lubricant to alkaline water does not cause a significant improvement in the proportion of failed bottles in the PET compatibility test relative to alkaline water alone.

Example 1

Silicone Lubricant Plus Succinic Acid/Sodium Succinate

A lubricant concentrate composition was prepared by adding 5 g Lambent E-2140FG, 7.9 g succinic acid, 2.7 g of a 50% solution of NaOH, and 1.7 g of an 18% solution of Pluronic F-108 poly(ethylene oxide-propylene oxide) block copolymer to 82.7 g deionized water. A lubricant composition was prepared by diluting 1.0 g of the lubricant concentrate composition with 399 g of a solution of 168 ppm sodium bicarbonate in deionized water. The resulting lubricant composition contained 125 ppm Lambent E2140FG silicone emulsion, 7.6 ppm Pluronic F108, 198 ppm succinic acid, 34 ppm sodium hydroxide, and 168 ppm sodium bicarbonate (equivalent to 100 ppm alkalinity as $CaCO_3$). The ratio of unneutralized acid equivalents from the lubricant concentrate composition to equivalents of base from the alkaline water was 1.25 to 1.00. The pH of the lubricant composition was 4.23. The silicone lubricant composition was tested for PET compatibility whereupon after 28 days of storage under conditions of 100 F and 85% relative humidity, 8 of 96 bottles had failed (8%). The crazing score for the unfailed bottles in this test was 1.8. What this example shows is that including approximately 1.25 equivalents of unneutralized acid for every equivalent of alkalinity in lube dilution water is capable to reduce the failure rate of bottles in the PET compatibility test relative to a silicone plus water-miscible lubricant composition.

Example 2

Silicone Lubricant Plus Glutaric Acid/Sodium Glutarate

A lubricant concentrate composition was prepared by adding 5 g Lambent E-2140FG, 14.1 g glutaric acid, 4.3 g of a 50% solution of NaOH, and 1.7 g of an 18% solution of Pluronic F-108 poly(ethylene oxide-propylene oxide) block copolymer to 74.9 g deionized water. A lubricant composition was prepared by diluting 1.0 g of the lubricant concentrate composition with 399 g of a solution of 168 ppm sodium bicarbonate in deionized water. The resulting lubricant composition contained 125 ppm Lambent E2140FG silicone emulsion, 7.6 ppm Pluronic F108, 353 ppm glutaric acid, 54 ppm NaOH, and 168 ppm sodium bicarbonate (equivalent to 100 ppm alkalinity as $CaCO_3$). The ratio of unneutralized acid equivalents from the lubricant concentrate composition to equivalents of base from the alkaline water was 2.00 to 1.00. The pH of the lubricant composition was 4.25. The silicone lubricant composition was tested for PET compatibility whereupon after 28 days of storage under conditions of 100 F and 85% relative humidity, 0 of 96 bottles had failed (0%). The crazing score for the unfailed bottles in this test was 2.3. What this example shows is that including approximately two equivalents of unneutralized acid for every equivalent of alkalinity in lube dilution water is capable to reduce the failure rate of bottles in the PET compatibility test relative to a silicone plus water-miscible lubricant composition.

Example 3

Silicone Lubricant Plus Citric Acid/Sodium Citrate

A lubricant concentrate composition was prepared by adding 2.5 g Lambent E-2140FG, 14.1 g of 50% citric acid, 2.2 g of a 50% solution of NaOH, 0.84 g of an 18% solution of Pluronic F-108 poly(ethylene oxide-propylene oxide) block copolymer, and 2.85 g of 35% hydrogen peroxide solution to 74.9 g deionized water. A lubricant composition was prepared by diluting 2.0 g of the lubricant concentrate composition with 398 g of a solution of 168 ppm sodium bicarbonate in deionized water. The resulting lubricant composition contained 125 ppm Lambent E-2140FG silicone emulsion, 353 ppm citric acid, 54 ppm NaOH, 7.6 ppm Pluronic F-108 poly(ethylene oxide-propylene oxide) block copolymer, 50 ppm $H_2O_2$, and 168 ppm sodium bicarbonate (equivalent to 100 ppm alkalinity as $CaCO_3$). The ratio of unneutralized acid equivalents from the lubricant concentrate composition to equivalents of base from the alkaline water was 2.08 to 1.00. The silicone lubricant composition was tested for PET compatibility as described above. After 28 days of storage under conditions of 100 F and 85% relative humidity, 0 of 96 bottles had failed (0%). The crazing score for the unfailed bottles in this test was 1.4. What this example shows is that including approximately two equivalents of unneutralized acid for every equivalent of alkalinity in lube dilution water is capable to reduce the failure rate of bottles in the PET compatibility test relative to a silicone plus water-miscible lubricant composition.

In a separate test, 20 g of the lubricant concentrate composition was diluted with 10 Kg of city water and the coefficient of friction using the Short Track Conveyor Test described above. The coefficient of friction between 4 20 ounce "Global Swirl" bottles and Delrin track was 0.13.

Example 4

Silicone Lubricant Plus Citric Acid/Sodium Citrate Plus Alcohol Ethoxylate Wetting Agent A lubricant concentrate composition was prepared by adding 2.5 g of Dow Corning HV-490 silicone emulsion, 7.0 g citric acid, 2.1 g of a 50% solution of NaOH, 2.0 g of Tomadol 91-8 alcohol ethoxylate, and 2.85 g of a 35% solution of $H_2O_2$ to 83.6 g deionized water. A lubricant composition was prepared by diluting 1.0 g of the lubricant concentrate composition with 399 g of a solution of 168 ppm sodium bicarbonate in deionized water. The resulting lubricant composition contained 63 ppm Dow Corning HV-490 silicone emulsion, 175 ppm citric acid, 26 ppm NaOH, 50 ppm Tomadol 91-8 alcohol ethoxylate, 25 ppm $H_2O_2$, and 168 ppm sodium bicarbonate (equivalent to 100 ppm alkalinity as $CaCO_3$). The ratio of unneutralized acid equivalents from the lubricant concentrate composition to equivalents of base from the alkaline water was 1.00 to 1.00. The pH of the lubricant composition was 5.94. The contact angle of the lubricant composition on PET film was determined to be 58 degrees. The wetting behavior of the lubricant composition was evaluated by the coating test described above. Upon coating, the composition beaded up immediately and dried to give spots which covered less than 5% of the PET surface. The foam profile value for the composition measured as described above was 1.3. The silicone lubricant composition was tested for PET compatibility as described, except that 20 oz "Contour" bottles available from Southeastern Container Corp. (Enka, N.C.) were substituted for 20 ounce "Global Swirl" bottles. After 28 days of storage under conditions of 100 F and 85% relative humidity, 1 of 96 bottles had failed (1%). The crazing score for the unfailed bottles in this test was 3.4. What this example shows is that including approximately one equivalent of unneutralized acid for every equivalent of alkalinity in lube dilution water and decreasing the contact angle of the lubricant composition to less than about 60 degrees is capable to reduce the failure rate of bottles in the PET compatibility test relative to a silicone plus water-miscible lubricant composition. In a separate test, 20 g of the lubricant concentrate composition was diluted with 10 Kg of city water and the coefficient of friction using the Short Track Conveyor Test described above. The coefficient of friction between 4 20 ounce "Global Swirl" bottles and Delrin track was 0.11.

Comparative Example D

Deionized Water with 200 ppm Added Alkalinity

A solution of deionized water containing 200 ppm alkalinity as $CaCO_3$ was prepared by dissolving 0.336 g of sodium bicarbonate in 1000 g of deionized water. The ratio of unneutralized acid equivalents to equivalents of base from the alkaline water was 0 to 1.00. The contact angle of the solution on PET film was determined to be 67 degrees. The wetting behavior of the solution was evaluated by the coating test described above. Upon coating, the solution beaded up immediately giving isolated drops which dried to give water spots which covered approximately 5% of the film surface. The foam profile value for the solution measured as described above was 1.0. The alkaline water solution was tested for PET compatibility as described above. After 28 days of storage under conditions of 100 F and 85% relative humidity, 20 of 96 bottles had failed (21%). The visual crazing score for the unfailed bottles in this test was 1.7.

Comparative Example E

Silicone Plus Water-miscible Lubricant

A lubricant concentrate composition was prepared by adding 5 g Lambent E-2140FG, 1.7 g of an 18% solution of Pluronic F-108 poly(ethylene oxide-propylene oxide) block copolymer, 5.7 g of 35% hydrogen peroxide, and 0.4 g of 1% citric acid solution to 87.2 g deionized water. A lubricant composition was prepared by diluting 2.0 g of the lubricant concentrate composition with 398 g of a solution of 336 ppm sodium bicarbonate in deionized water. The resulting lubricant composition contained 250 ppm Lambent E2140FG silicone emulsion, 15.0 ppm Pluronic F108, 0.2 ppm citric acid, and 336 ppm sodium bicarbonate (equivalent to 200 ppm alkalinity as $CaCO_3$). The ratio of unneutralized acid equivalents from the lubricant concentrate composition to equivalents of base from the alkaline water was 0.001 to 1.00. The pH of the lubricant composition was 8.20. The silicone lubricant composition was tested for PET compatibility whereupon after 28 days of storage under conditions of 100 F and 85% relative humidity, 45 of 288 bottles had failed (16%). What this comparative example shows is that addition of a mixture of silicone plus water-miscible lubricant to alkaline water does not cause a significant improvement in the proportion of failed bottles in the PET compatibility test relative to alkaline water alone.

Comparative Example F

Silicone Lubricant Plus Adipic Acid

A lubricant concentrate composition was prepared by adding 5 g Lambent E-2140FG, 1.7 g of an 18% solution of Pluronic F-108 poly(ethylene oxide-propylene oxide) block copolymer, 5.7 g of 35% hydrogen peroxide, and 1.0 g of adipic acid to 87.8 g deionized water. A lubricant composition was prepared by diluting 2.0 g of the lubricant concentrate composition with 398 g of a solution of 334 ppm sodium bicarbonate in deionized water. The resulting lubricant composition contained 250 ppm Lambent E2140FG silicone emulsion, 15.3 ppm Pluronic F108, 50 ppm adipic acid, and 334 ppm sodium bicarbonate (equivalent to 200 ppm alkalinity as $CaCO_3$). The ratio of unneutralized acid equivalents from the lubricant concentrate composition to equivalents of base from the alkaline water was 0.17 to 1.00. The pH of the lubricant composition was 7.20. The silicone lubricant composition was tested for PET compatibility whereupon after 28 days of storage under conditions of 100 F and 85% relative humidity, 21 of 120 bottles had failed (18%). The crazing score for the unfailed bottles in this test was 2.4. What this comparative example shows is that neutralization of alkalinity to approximately pH 7 in a silicone lubricant composition did not reduce the failure rate of bottles in the PET compatibility test relative to a silicone lubricant composition or to alkaline water alone.

Example 5

Silicone Lubricant Plus Fatty Amine Plus Alcohol Ethoxylate Wetting Agent Plus Lactic Acid An acidified fatty amine solution was prepared by adding 29 g of glacial acetic acid and 80.0 g of Duomeen OL (available from Akzo Nobel Surface Chemistry LLC, Chicago, Ill.) to 691 g of deionized water. A lubricant concentrate composition was prepared by adding 25.0 g of acidified fatty amine solution, 8.0 g of Surfonic L 24-7 surfactant, 6.5 g of 88% lactic acid, and 2.5 g of Lambent E2140FG silicone emulsion to 58.0 g of deionized water. A lubricant composition was prepared by adding 5.0 g of the lubricant concentrate composition to a solution of 0.168 g of sodium bicarbonate in 1000 g of deionized water. The lubricant composition contained 125 ppm Lambent E2140FG silicone emulsion, 125 ppm of Duomeen OL, 400 ppm of Surfonic L 24-7, 286 ppm lactic acid, and 168 ppm sodium bicarbonate (equivalent to 100 ppm alkalinity as $CaCO_3$). The ratio of unneutralized acid equivalents from the lubricant concentrate composition to equivalents of base from the alkaline water was 1.59 to 1.00. The contact angle of the lubricant composition on PET film was determined to be 39 degrees. The wetting behavior of the lubricant composition was evaluated by the coating test described above. Upon coating, the composition gave a film with approximately 30 pencil eraser size de wet spots which dried to give an imperfect film which covered approximately 75% of the PET surface. The foam profile value for the composition measured as described above was 1.7. The lubricant composition was tested for PET compatibility as described, except that 20 oz "Contour" bottles available from Southeastern Container Corp. (Enka, N.C.) were substituted for 20 ounce "Global Swirl" bottles. After 28 days of storage under conditions of 100 F and 85% relative humidity, 0 of 96 bottles had failed (0%). The visual crazing score for the unfailed bottles in this test was 7.6. What this example shows is that addition of a wetting agent comprising a mixture of acidified fatty amine and alcohol ethoxylate compounds and a stoichiometric amount of organic acid to a silicone lubricant composition causes an improvement in wetting of the composition to a PET surface and an improvement in the proportion of failed bottles in the PET compatibility test relative to a silicone plus water-miscible lubricant composition.

Various modifications and alterations of this invention will be apparent to those skilled in the art without departing from the scope and spirit of the invention, and are intended to be within the scope of the following claims.

What is claimed is:

1. A method for lubricating the passage of a container along a conveyor, comprising a. providing a lubricant concentrate composition comprising
   i. from about 0.05% to about 20% of a water-miscible silicone material; and
   ii. one or more acid compounds in an amount sufficient to provide at least one equivalent of available, unneutralized acid for every two equivalents of alkalinity in water used to dilute the lubricant concentrate;
b. diluting the lubricant concentrate with water in a ratio of one part lubricant concentrate to 100 to 1000 parts water to form a lubricant use composition; and
c. applying the lubricant use composition to at least a portion of the container-contacting surface of the conveyor or to at least a portion of the conveyor-contacting surface of the container;

wherein the pH of the lubricant use composition is less than about 6.4.

2. The method of claim 1, wherein the water used to dilute the lubricant concentrate composition comprises greater than about 50 ppm alkalinity as $CaCO_3$.

3. The method of claim 1, wherein the silicone material is selected from the group consisting of silicone emulsion, finely divided silicone powder, and silicone surfactant.

4. The method of claim 1, wherein the lubricant concentrate composition further comprises one or more functional ingredients selected from the group of water-miscible lubricants, wetting agents, hydrophilic diluents, antimicrobial agents, stabilizing/coupling agents, detergents/ dispersing agents, anti-wear agents, viscosity modifiers, sequestrants, corrosion inhibitors and mixtures thereof.

5. The method of claim 1, wherein the container comprises one or more polymers selected from the group of polyethylene terephthalate, polyethylene naphthalate, and bisphenol A carbonate.

6. The method of claim 1, wherein the lubricant concentrate composition comprises one or more acid compounds in an amount sufficient to provide at least two equivalents of available, unneutralized acid for every two equivalents of alkalinity in water used to dilute the lubricant concentrate composition.

7. The method of claim 1, wherein the lubricant concentrate composition comprises one or more acid compounds in an amount sufficient to provide at least three equivalents of available, unneutralized acid for every two equivalents of alkalinity in water used to dilute the lubricant concentrate composition.

8. The method of claim 1, wherein the lubricant use composition is applied for a period of time and off for a period of time and the ratio of applied time to off time is at least 1: 1.

9. The method of claim 1, wherein the lubricant concentrate composition comprises one or more organic carboxylic acid compounds selected from the group consisting of acetic, lactic, succinic, glutaric, adipic, and citric acid and mixtures thereof.

10. A method for lubricating the passage of a container along a conveyor, comprising:

a. providing a lubricant concentrate composition comprising
   i. from about 0.05% to about 20.0% of a water-miscible silicone material; and
   ii. greater than about 0.05 equivalents of acid per Kg of the lubricant concentrate composition before reaction with alkalinity in water used to prepare the lubricant use composition;
b. diluting the lubricant concentration composition with water to form a lubricant use composition; and c. applying the lubricant use composition to at least a portion of the container-contacting surface of the conveyor or to at least a portion of the conveyor-contacting surface of the container;

wherein the pH of the lubricant use composition is less than about 6.4.

11. The method of claim 10, wherein the water used to dilute the lubricant concentrate composition comprises greater than about 50 ppm alkalinity as $CaCO_3$.

12. The method of claim 10, wherein the silicone material is selected from the group consisting of silicone emulsion, finely divided silicone powder, and silicone surfactant.

13. The method of claim 10, wherein the lubricant composition further comprises one or more functional ingredients selected from the group of water-miscible lubricants, wetting agents, hydrophilic diluents, antimicrobial agents, stabilizing/coupling agents, detergents/ dispersing agents, anti-wear agents, viscosity modifiers, sequestrants, corrosion inhibitors and mixtures thereof.

14. The method of claim 10, wherein the container comprises one or more polymers selected from the group of polyethylene terephthalate, polyethylene naphthalate, and bisphenol A carbonate.

15. The method of claim 10, wherein the lubricant concentrate composition comprises greater than about 0.1 equivalents of acid per Kg of the concentrate composition before reaction with alkalinity in water used to prepare the use composition.

16. The method of claim 10, wherein the lubricant concentrate composition comprises greater than about 0.15 equivalents of acid per Kg of the concentrate composition before reaction with alkalinity in water used to prepare the use composition.

17. The method of claim 10, wherein the lubricant composition is applied for a period of time and off for a period of time and the ratio of applied time to off time is at least 1:1.

18. The method of claim 10, wherein the lubricant concentrate composition comprises one or more organic carboxylic acid compounds selected from the group consisting of consisting of acetic, lactic, succinic, glutaric, adipic, and citric acid and mixtures thereof.

19. A lubricant concentrate composition comprising from about 0.05 to about 20% of a water-miscible silicone material selected from the group consisting of silicone emulsion, finely divided silicone powder, and silicone surfactant and greater than about 0.05 equivalents of unneutralized acid per kg of the concentrate composition wherein the acid is selected from the group consisting of consisting of acetic, lactic, succinic, glutaric, adipic, and citric acid and mixtures thereof wherein the amount of unneutralized acid in the concentrate composition is sufficient to provide a pH of less than about 6.4 when in use.

20. The lubricant concentrate composition of claim 19, comprising greater than about 0.1 equivalents of unneutralized acid per kg of the concentrate composition.

21. The lubricant concentrate composition of claim 20 comprising greater than about 0.15 equivalents of unneutralized acid per kg of the concentrate composition.

* * * * *